US006609501B2

(12) United States Patent
Doane et al.

(10) Patent No.: US 6,609,501 B2
(45) Date of Patent: Aug. 26, 2003

(54) FUEL PRESSURE REGULATION SYSTEM

(75) Inventors: Kirk D. Doane, Essexville, MI (US); John D. Zmierski, Cass City, MI (US)

(73) Assignee: Walbro Corporation, Cass City, MI (US)

( * ) Notice: Subject to any disclaimer, the term of this patent is extended or adjusted under 35 U.S.C. 154(b) by 132 days.

(21) Appl. No.: 09/833,375

(22) Filed: Apr. 12, 2001

(65) Prior Publication Data

US 2002/0148445 A1 Oct. 17, 2002

(51) Int. Cl.[7] ..... F02M 59/20
(52) U.S. Cl. ..... 123/458; 123/497
(58) Field of Search ..... 123/497, 458, 123/510; 417/44.1, 44.11, 44.2

(56) References Cited

U.S. PATENT DOCUMENTS 4,756,291 A * 7/1988 Cummins et al. ..... 123/497
4,789,308 A 12/1988 Tuckey ..... 417/44
5,406,922 A * 4/1995 Tuckey ..... 123/497
5,715,797 A * 2/1998 Minagawa et al. ..... 123/497
5,842,454 A * 12/1998 Miwa et al. ..... 123/497
6,119,655 A * 9/2000 Heinitz et al. ..... 123/447
6,453,878 B1 * 9/2002 Mazet ..... 359/665

* cited by examiner

*Primary Examiner*—Tony M. Argenbright
*Assistant Examiner*—Arnold Castro
(74) *Attorney, Agent, or Firm*—Reising, Ethington, Barnes, Kisselle, P.C.

(57) ABSTRACT

A fuel pressure regulation system for an internal combustion engine to regulate fuel pressure using a two-state pressure switch. In addition to the pressure switch, the system includes a control circuit, a current sensor, and a fuel pressure control device such as a fuel pump. The control circuit uses the pressure switch to sense whether the downstream fuel pressure is above or below a desired reference pressure. When below the reference pressure, the control circuit drives the fuel pump at full on to increase the fuel line pressure to the reference pressure. Once the fuel pressure rises and increases to or past the reference pressure, the pressure switch changes state, at which point the current sensor is used to sample and record the magnitude of the electric current supplied to the fuel pump at the moment the switch state changes. As long as the fuel line pressure is above the reference pressure, this stored value is used as a reference value in conjunction with the current measurement reading from the current sensor to provide closed loop control of the fuel pump operating current.

24 Claims, 2 Drawing Sheets

FUEL PRESSURE REGULATION SYSTEM

FIELD OF THE INVENTION

This invention relates generally to fuel delivery systems used with internal combustion engines and, more particularly, to fuel pressure regulation systems designed for marine engines.

BACKGROUND OF THE INVENTION

Electric motor fuel pumps have been used in a wide range of applications to deliver fuel to internal combustion engines. One such use of electric fuel pumps is in the form of a constant delivery fuel pump, in which the electric fuel pump is operated at a constant speed with a pressure regulator being used to return excess fuel from the engine to the fuel tank. It should be noted that there are many disadvantages associated with a fuel pressure regulator system of this kind. For instance, the returned or excess fuel carries engine heat with it back to the fuel tank, thereby increasing the temperature and vapor pressure within the tank. Venting this vapor pressure into the atmosphere causes pollution problems and adversely affects fuel mileage. Additionally, operating the electric motor at a constant high speed increases energy consumption and reduces the operational life of the fuel pump, fuel filter, and other components of the system.

Another type of fuel delivery application uses a feedback loop to control the speed of the fuel pump, the duration of operation, or other operational parameters of the pump that affect the fuel line pressure. Unlike the constant delivery fuel pump previously described, fuel pressure regulation systems incorporating a feedback loop drive the fuel pump according to required output. For example, see U.S. Pat. No. 4,789,308, which discloses a self-contained fuel pump that includes an electronic sensor at the pump outlet which measures the outlet fuel pressure and modulates the electrical current supplied to the pump motor so as to maintain constant pressure in the fuel delivery line. While it is recognized that fuel pressure regulation systems utilizing pressure sensors and feedback loops avoid many of the drawbacks attributed to constant delivery pumps, such as energy consumption and wear-and-tear, those systems introduce disadvantages of their own. For example, a significant concern confronting the implementation of these pressure sensors is the harshness of the environment in which they are used and, in particular, their incompatibility with the corrosive fuel. Some of these concerns have been mitigated through the use of stainless steel components. However, there remain certain sensor components, such as those located on the reference side of the pressure sensor, which are not protected from the harsh environment, consequently, "outside-of-environment" sensing is often necessary. Also, the measures taken to counter the corrosive conditions of the environment significantly increase the cost of these components.

Thus, it would be advantageous to provide a fuel pressure regulation system having the advantages of closed loop control while avoiding the problems inherent in the use of pressure sensors.

SUMMARY OF THE INVENTION

In accordance with the present invention, there is provided a fuel pressure regulation system that uses a control circuit to operate a fuel pump or other fuel pressure control device in one of two or more modes depending upon the input received from a pressure switch in the fuel line. The pressure switch provides the control circuit with an indication of whether the fuel pressure is above or below a reference pressure. When the fuel pressure is below the reference pressure, the control circuit operates the fuel pressure control device in a first one of the modes to increase the fuel pressure towards the reference pressure. When the fuel pressure is above the reference pressure, the control circuit operates the fuel pressure control device in a second one of the modes to provide closed loop control of the operating current supplied to the control device.

Thus, the present invention uses a pressure switch, a current sensor, and a control circuit to provide closed loop control to a fuel pressure control device based on the premise of determining the amount of electric current needed to maintain the fuel pressure at the reference pressure and then regulating the operating current of the fuel pressure control device to maintain that level of current.

Preferably, the control circuit provides a pulse width modulated control signal that is used to operate the fuel pressure control device. Also, the closed loop control is preferably implemented by storing the current signal from the current sensor as a reference value each time the pressure switch detects that the fuel pressure has crossed the reference pressure in the positive (pressure rising) direction, and then using that reference value as a setpoint for the closed loop control.

In accordance with another aspect of the present invention, the fuel pressure regulation system can be implemented as a part of a fuel delivery system for an internal combustion engine. In addition to the components of the fuel pressure regulation system identified above, the fuel delivery system also includes a fuel supply, a fuel delivery pump, and an injector. The delivery pump draws fuel from the fuel supply and delivers it to the fuel pressure regulation system where the system manages the outlet fuel pressure as indicated above. The fuel is then delivered to the injector for subsequent injection into a combustion chamber of the engine.

A primary advantage of this invention is that it permits fuel pressure regulation in a fuel system that can be constructed using an inexpensive pressure switch, with the fuel system obviating temperature drift instability and fuel incompatibility and being more reliable and economical to manufacture and assemble relative to other designs that provide such fuel pressure regulation.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
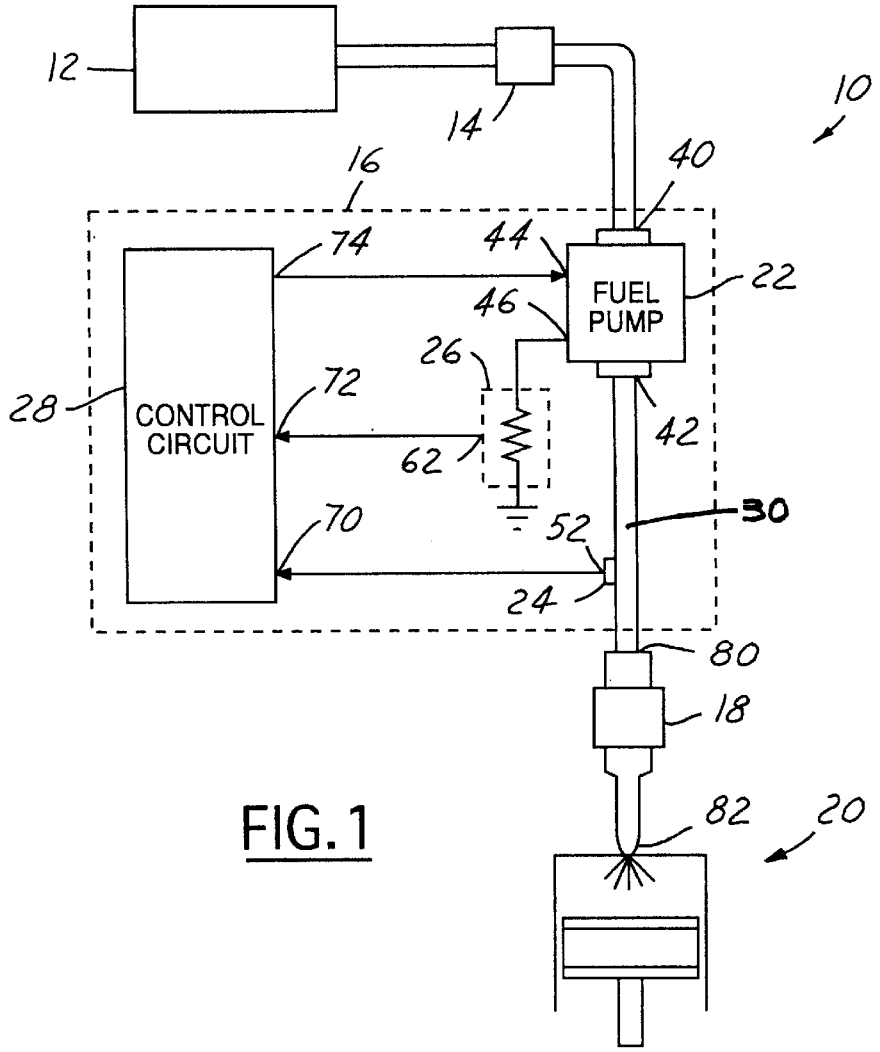
FIG. 1 is a block diagram of a preferred embodiment of a fuel delivery system, including a fuel pressure regulation system, as it would be used with an internal combustion engine.

With reference to FIG. 1, there is shown a fuel delivery system 10 that regulates the downstream pressure of fuel delivered to a combustion chamber of an internal combustion engine and generally includes a fuel tank 12, a fuel delivery pump 14, a fuel pressure regulation system 16, an injector 18, and a cylinder assembly 20. Fuel delivery pump 14 is a low pressure fuel pump that draws fuel from fuel tank 12 and delivers the fuel under a low pressure, typically 10 p.s.i., to the fuel pressure regulation system 16. The fuel pressure regulation system includes a fuel pump or other fuel pressure control device 22, a pressure switch 24, a current sensor 26, and a control circuit 28, and this system regulates the downstream fuel pressure between the fuel pump 22 and the injector 18 by operating the fuel pump in one of two modes depending on the state of the pressure switch 24, as will be subsequently explained. The regulated fuel is then delivered to injector 18 which introduces the fuel into the combustion chamber of the cylinder assembly 20, as is commonly known in the art.

The control circuit 28 controls operating power to the fuel pump 22, with the pressure switch 24 and current sensor 26 respectively providing fuel line pressure and pump operating current feedback information to the control circuit 28. As will be described in greater detail below, control circuit 28 operates the fuel pump in either of two modes depending upon the state of pressure switch 24. When the pressure switch is in a first state (e.g., switch open) indicating that the fuel line pressure is below some preset reference pressure setting for the switch, the control circuit operates in a first mode to output a control signal to fuel pump 22 that causes it to increase the fuel line pressure. This continues until the fuel line pressure reaches the reference pressure, at which point the pressure switch 24 switches to a second state. When the switch is in this second state, control circuit 28 then operates in the second mode to provide closed loop control of the operating current supplied to the fuel pump 22, and it provides this closed loop control using the current signal from the current sensor 26 as feedback along with a stored reference value that is representative of the desired current level.

Although a fuel pump is used in the disclosed embodiment, the fuel pressure control device 22 can be any of a number of other types of devices that provide regulation of downstream fuel pressure. For example, a regulating valve could be used to supply fuel from a higher pressure supply line. In the illustrated embodiment, fuel pressure control device 22 is an electric motor driven, high pressure fuel pump having a fuel inlet 40, a fuel outlet 42, and a control signal input 44 along with an associated ground line 46. The fuel inlet receives fuel from the fuel delivery pump 14 and is in fluid communication with the fuel outlet. After fuel passes through the fuel pump 22, it exits the device through the fuel outlet 42, which is in fluid communication with the injector 18 via a downstream fuel segment 30. The downstream fuel pressure, meaning the fuel pressure in the downstream fuel segment 30, is controlled by the operation of the fuel pump 22 and is substantially uniform throughout the segment. As will be subsequently explained, this downstream pressure determines the switch state of pressure switch 24. Current sensor 26 measures the pump 22 operating current and transmits a signal representative of the magnitude of this electrical current to the control circuit 28. Signal input 44 is electronically connected to control circuit 28 to receive a control signal that provides variable control of the fuel pump. As will be appreciated, control circuit 28 can include a suitable motor driver output stage so that the control signal can be used to provide operating power directly to the fuel pump 22. Alternatively, the fuel pump itself can include a suitable driver stage that draws power from a separately connected source such as a battery, in which case the control signal is used merely as a data signal to specify the desired operating level of the fuel pump.

Pressure switch 24 is preferably a two-state pressure switch capable of generating a switch state signal indicative of either a first state that indicates that the downstream fuel pressure is below a predefined pressure threshold, also referred to as the reference pressure, or a second state that indicates that the downstream fuel pressure is above the reference pressure. The pressure switch includes an output 52 that is connected to the control circuit 28 so that the control circuit can detect which state the pressure switch is in. The reference pressure is a pre-determined characteristic of the switch that is selected to equal an ideal downstream pressure, and may be unchangeable or changeable by the operator depending upon the type of switch used. The pressure switch may be mounted to any component such that the switch is in communication with the downstream fuel. For example, the downstream fuel segment 30 and fuel outlet 42 are logical choices for such a mounting. The pressure switch may be placed within the fuel tank if desired, and can be attached to the fuel pump bracketry or housing. Engine fuel rail mounting of the switch is also possible.

Current sensor 26 determines the amount of electric current being used by the fuel pressure control device and includes a signal output 62 that is connected to control circuit 28. As will be understood by those skilled in the art, current sensor 26 could be implemented in any of a number of different ways, including, for example, as a small valued resistor in the ground line 46 of the fuel pump 22. Other current sensing components could be used, either internally or externally of the fuel pump, and could be used to measure current entering the pump rather than leaving the pump through its ground line, as shown.

Control circuit 28 is preferably a microprocessor-based circuit that digitally processes the electrical signals received from pressure switch 24 and current sensor 26, and that generates and transmits the control signal to the fuel pump based on programming instructions executed by the microprocessor. Alternatively, a purely analog circuit could be used. The control circuit may consist of one of any number of different combinations of components, but generally includes a first signal input 70, a second signal input 72, and a signal output 74. First signal input 70 is connected to signal output 52 of the pressure switch for receiving the switch state signal indicating the state of the switch, and the second signal input 72 is connected to signal output 62 of the current sensor for receiving the current signal representative of the electric current being used by the fuel pump. Signal output 74 is connected to signal input 44 of the fuel pump and is used to transmit the control signal used to operate the pump.

Although variable control of the fuel pump 22 by the control circuit 28 can be accomplished in a number of different ways, the illustrated embodiment uses pulse-width modulation to vary the amount of power delivered to the fuel pump. When the pressure switch is in its first state (indicating that the fuel line pressure is below the reference pressure), the control circuit operates the fuel pressure control device, via the control signal, at one hundred percent duty cycle voltage. That is, it operates the fuel pump at full on to drive the fuel pressure upwards to the reference pressure. Then, when the pressure switch switches to the second state (indicating that the fuel pressure is now at or above the reference pressure), the control circuit no longer drives the fuel pump with a constant duty cycle signal. Rather, the control circuit 28 drives the fuel pump via the control signal with a pulse-width modulated signal that is determined using the current signal and the stored reference value.

As mentioned above, control circuit 28 provides closed loop control of the operating current to the fuel pump 22 when operating in the second mode. This is done using the current signal from current sensor 26 as feedback, along with the stored reference value that is indicative of the desired current. Control circuit 28 uses a proportional plus integral control scheme to maintain the pump operating current at the desired level represented by the stored reference value. The various requirements and considerations for implementing proportional plus integral control are well known to those skilled in the art and will therefore not be further elaborated on here. Other control schemes and/or control techniques can also be used, depending upon the characteristics desired for the closed loop control. For example, the integral control can include an anti-windup algorithm or circuitry. As another example, differential control can be included in addition to or in lieu of the integral and/or proportional control.

Figure 2:
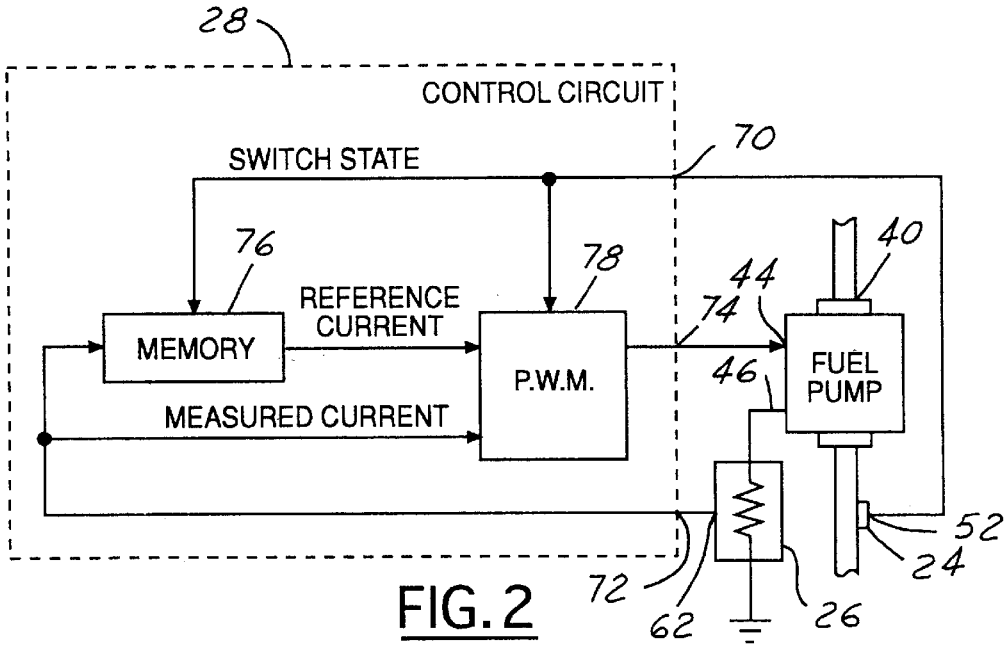
FIG. 2 is a block diagram of a preferred embodiment of the fuel pressure regulation system of FIG. 1.

With reference now to FIG. 2, the basic control scheme for control circuit 28 is shown. It will be understood that the block diagram of FIG. 2 is a functional representation of the construction of control circuit 28 and that the actual circuitry can be implemented in a variety of different ways. Control circuit 28 includes both a memory 76 and a pulse width modulation (PWM) circuit 78. The memory 76 stores the current reference value used for closed loop control and the PWM circuit 78 generates the fuel pump control signal depending on the state of the pressure switch output and (when in the second mode) the current measurement and stored reference value inputs. More specifically, when the pressure switch is in the first state, the PWM unit 78 operates at full on to produce a constant one hundred percent duty cycle control signal. This is done to increase the fuel line pressure towards the reference pressure regardless of the reference value and current measurement inputs. Once the switch state signal changes to the second state, indicating that the fuel line pressure has now reached the preset reference pressure, the PWM unit 78 switches to closed loop control mode in which it produces the control signal as a pulse width modulated signal based on the instantaneous and accumulated error between the measured fuel pump current and the stored reference value.

In the illustrated embodiment, the current reference value that is stored in memory 76 and used as a setpoint for the closed loop control can be obtained by sampling the current from the current sensor 26 at the point at which the pressure switch 24 changes from its first state to its second state. This sampled current measurement is stored in memory 76 and thus represents the operating current needed to produce the reference pressure. This stored value can be updated each time the fuel line pressure increases from below the reference pressure and then crosses the reference pressure threshold. In this way, the circuit accounts for any changes or drift in the current versus pressure relationship. Updating of the reference value can be done in different ways, such as by replacing the value each time with the new value, or by averaging or otherwise mathematically combining the new value with the old. Also, the update can be done each time the threshold is crossed in the pressure increasing direction, pressure decreasing direction, or in both directions, or can be done just once each time the engine is started. As will be appreciated, this updating in effect provides a periodic recalibration of the reference value.

Referring again briefly to FIG. 1, injector 18 is a typical fuel injector used in conjunction with an internal combustion engine, and comprises a fuel inlet 80 and an outlet nozzle 82. The fuel inlet receives fuel from the fuel pressure control device via the downstream fuel segment under the force of the downstream fuel pressure. The injector can be electrically or mechanically operated and can be of any suitable design. Accordingly, further elaboration of the injector is deemed unnecessary and is therefore omitted.

Figure 3:
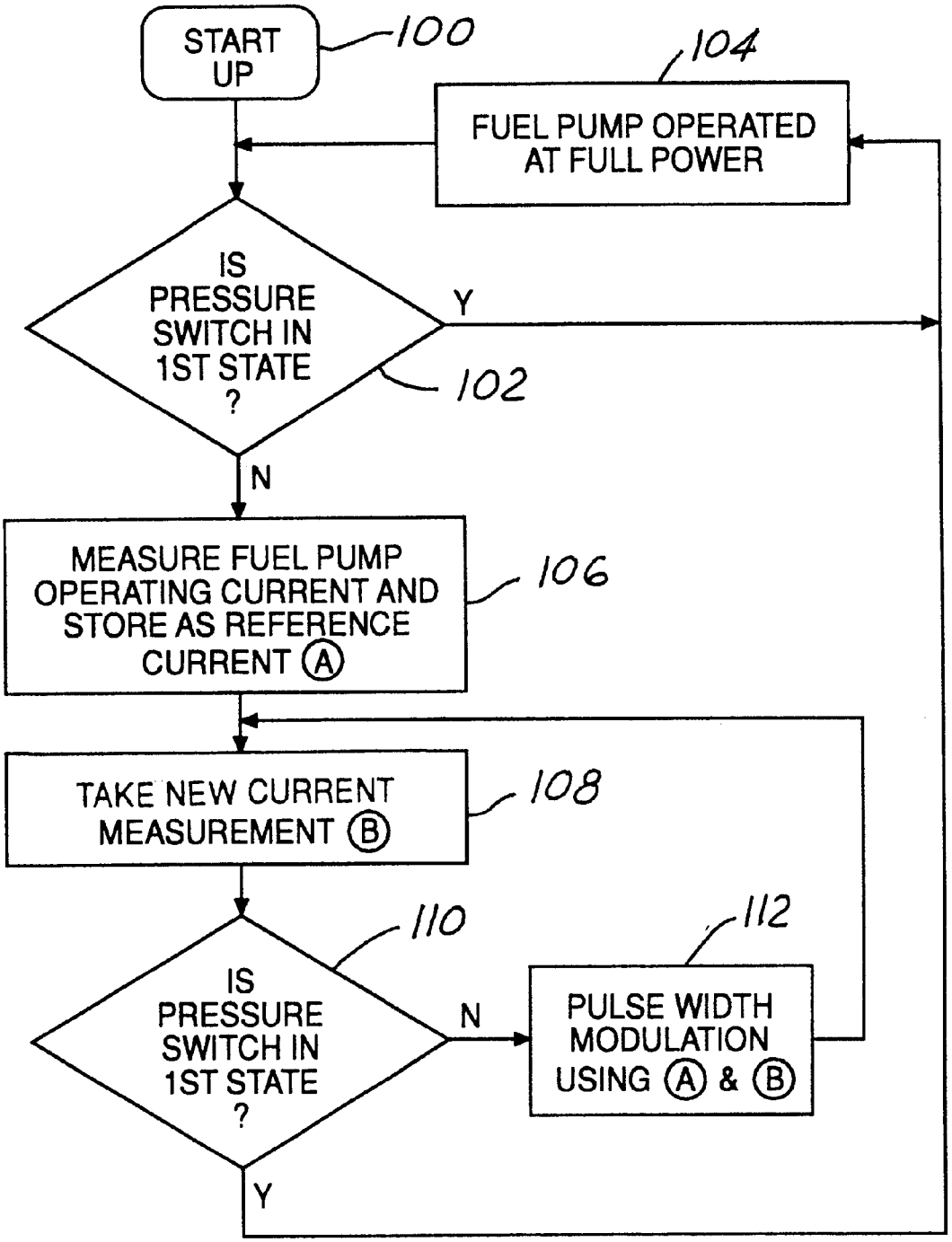
FIG. 3 is a flowchart illustrating the operational steps of the fuel pressure regulation system of FIG. 1.

Referring now to FIG. 3, there is shown the operational steps taken by the fuel pressure regulation system 16 to deliver fuel to the injector 18 at an acceptable pressure. More specifically, FIG. 3 depicts the process used by the fuel pressure regulation system to maintain the downstream fuel pressure at a level that coincides with the reference pressure of the pressure switch. In use, the fuel pressure regulation system begins at the start up step 100, which supplies operational power to the various components of the fuel pressure regulation system 16 in the event that they were previously turned off.

Following initial start up, control circuit 28 receives the switch state signal from the pressure switch 24 to determine the present state of the switch, step 102. If the pressure switch is in the first state, indicating that the downstream fuel pressure is currently below the reference pressure, then the control circuit transmits a control signal that drives the fuel pump full on (one hundred percent duty cycle), step 104. The control circuit 28 continues to drive the fuel pump with this constant voltage signal until the control circuit detects that the switch state signal from the pressure switch has changed to the second state. Upon detecting this change, indicating that the downstream pressure equals or surpasses the switch reference pressure, the control circuit 28 samples the electric current being used by the fuel pump, via current sensor 26, as seen in step 106.

Thus, step 106 establishes the current reference value, CURRENT A, which represents the amount of electric current required by the fuel pump to set the downstream pressure at a level equal to the reference pressure. This current reference value (CURRENT A) is stored by the memory 76 and, until a new value is established, this reference value is used by the control of the fuel pump. The closed loop control process then begins at step 108, where the instantaneous fuel pump operating current is again measured for use in the proportional and integral control of the pump current and, hence, the fuel line pressure. This second measurement is referred to as CURRENT B.

At step 110, the control circuit again checks the pressure switch to determine what state it is in, as previously explained in step 102. If the control circuit determines that the switch is still in the second state, then the control circuit uses the values for CURRENTS A and B to provide closed loop control of the fuel pump current, step 112. If the stored reference value, CURRENT A, is greater than the measured current, CURRENT B, then the control circuit will increase the duty cycle of the control signal, in an attempt to increase the current through the pump such that it equals that of the reference current. If the stored reference value, CURRENT A, is less than the measured current, CURRENT B, then the duty cycle of the control signal is decreased to lower the current through the fuel pump, again in an attempt to maintain the electrical current through the pump at a level equal to the stored reference value.

Following step 112, the system returns to step 108 to obtain a new current signal, CURRENT B. If the pressure switch is still in the second state, step 110, then a new pulse-width modulated control signal is generated at step 112, using the new CURRENT B value. This loop, involving the periodic sampling of current use by the pump (step 108), checking the state of the pressure switch (step 110), and using pulse-width modulation to vary the duty cycle of the control signal (step 112), continues until the downstream pressure seen at the pressure switch falls below the switch reference pressure, thereby causing the switch to go into the first state.

Once the system determines at step 110 that the pressure switch is back in the first state, the fuel pump is again driven by a constant one hundred percent duty cycle control signal, as seen in step 104. Following step 104, operating control passes back to step 102 and this loop between steps 102 and 104 continues until the pressure builds back up to the reference pressure and the pressure switch again switches to the second state. If desired, hysteresis can be built into the system to prevent too much oscillating back and forth between the two modes of operation.

It will thus be apparent that there has been provided in accordance with the present invention a fuel pressure regulation system for use in an internal combustion engine which achieves the aims and advantages specified herein. It will of course be understood that the foregoing description is of a preferred exemplary embodiment of the invention and that the invention is not limited to the specific embodiment shown. Various changes and modifications will become apparent to those skilled in the art. For example, when in the first mode, the fuel pump 22 need not be operated at full on, but only at some level of operation sufficient to increase the fuel line pressure to the reference pressure. All such variations and modifications are intended to come within the spirit and scope of the appended claims.

What is claimed is:

1. A fuel pressure regulation system for use with an internal combustion engine, comprising:

a fuel pressure control device having a fuel inlet for receiving fuel, a fuel outlet in fluid communication with said inlet, and a signal input for receiving a control signal, said fuel pressure control device being operable in response to said control signal to provide fuel to said outlet at a downstream fuel pressure that is dependent on said control signal, a pressure switch for sensing the downstream fuel pressure and having a signal output for providing a switch state signal, wherein said switch state signal is in a first state when the downstream fuel pressure is below a reference pressure and is in a second state when the downstream fuel pressure is above the reference pressure, a current sensor for sensing the electric current used by said fuel pressure control device as a result of being operated by said control signal, said current sensor being operable to provide a current signal representative of the magnitude of that electric current, and a control circuit having a first signal input connected to said pressure switch signal output to receive said switch state signal, a second signal input connected to said current sensor to receive said current signal, and a signal output connected to said fuel pressure control device signal input to provide said control signal, wherein, when said switch state signal is in said first state, said control circuit adjusts said control signal so as to operate said fuel pressure control device in a manner that increases the downstream fuel pressure until it reaches said reference pressure, and wherein, when said switch state signal is in said second state, said control circuit adjusts said control signal in accordance with the current signal so as to operate said fuel pressure control device using closed loop control of the electric current used by said control device.

2. The fuel pressure regulation system defined in claim 1, wherein said control circuit provides said closed loop control using said current signal and a stored reference value.

3. The fuel pressure regulation system defined in claim 2, wherein said control circuit is operable in response to said switch state signal changing from said first state to said second state to store the current signal received from the current sensor as the reference value, whereby said stored reference value is representative of the magnitude of electric current used by said fuel pressure control device to produce a downstream fuel pressure that is equal to the reference pressure.

4. The fuel pressure regulation system defined in claim 1, wherein said control circuit adjusts said control signal using pulse-width modulation when said switch state signal is in said second state.

5. The fuel pressure regulation system defined in claim 4, wherein said control circuit provides proportional control of said fuel pressure control device when said switch state signal is in said second state.

6. The fuel pressure regulation system defined in claim 5, wherein said control circuit also provides integral control of said fuel pressure control device when said switch state signal is in said second state.

7. A fuel pressure regulation system for use with an internal combustion engine, comprising:

a fuel pressure control device having a fuel inlet for receiving fuel, a fuel outlet in fluid communication with said inlet, and a signal input for receiving a control signal, said fuel pressure control device being operable in response to said control signal to provide fuel to said outlet at a downstream fuel pressure that is dependent on said control signal, a pressure switch for sensing the downstream fuel pressure and having a signal output for providing a switch state signal, wherein said switch state signal is in a first state when the downstream fuel pressure is below a reference pressure and is in a second state when the downstream fuel pressure is above the reference pressure, a current sensor for sensing the electric current used by said fuel pressure control device as a result of being operated by said control signal, said current sensor being operable to provide a current signal representative of the magnitude of that electric current, and a control circuit having a first signal input connected to said pressure switch signal output to receive said witch state signal, a second signal input connected to said current sensor to receive said current signal, and a signal output connected to said fuel pressure control device signal input to provide said control signal, wherein, when said switch state signal is in said first state, said control circuit adjusts said control signal so as to operate said fuel pressure control device in a manner that increases the downstream fuel pressure until it reaches said reference pressure, and wherein, when said switch state signal is in said second state, said control circuit adjusts said control signal in accordance with the current signal so as to operate said fuel pressure control device using closed loop control of the electric current used by said control device, and wherein said fuel press re control device comprises an electric, motor driven fuel pump.

8. The fuel pressure regulation system defined in claim 7, wherein said control circuit operates said fuel pump at a one hundred percent duty cycle when said switch state signal is in said first state.

9. The fuel pressure regulation system defined in claim 7, wherein said control circuit adjusts said control signal using pulse-width modulation when said switch state signal is in said second state.

10. The fuel pressure regulation system defined in claim 7, wherein said control circuit provides said closed loop control using said current signal and a stored reference value.

11. The fuel pressure regulation system defined in claim 10, wherein said control circuit is operable in response to said switch state signal changing from said first state to said second state to store the current signal received from the current sensor as the reference value, whereby said stored reference value is representative of the magnitude of electric current used by said fuel pump to produce a downstream fuel pressure that is equal to the reference pressure.

12. A fuel pressure regulation system for use with an internal combustion engine, comprising:

a fuel pressure control device having a fuel inlet for receiving fuel, a fuel outlet in fluid communication with said inlet, and a signal input for receiving a control signal, said fuel pressure control device being operable in response to said control signal to provide fuel to said outlet at a downstream fuel pressure that is dependent on said control signal, a pressure switch for sensing the downstream fuel pressure and having a signal output for providing a switch state signal, wherein said switch state signal is in a first state when the downstream fuel pressure is below a reference pressure and is in a second state when the downstream fuel pressure is above the reference pressure, a current sensor for sensing the electric current used by said fuel pressure control device as a result of being operated by said control signal, said current sensor being operable to provide a current signal representative of the magnitude of that electric current, and a control circuit having a first signal input connected to said pressure switch signal output to receive said itch state signal, a second signal input connected to said current sensor to receive said current signal, and a signal output connected to said fuel pressure control device signal input to provide said control signal, wherein, when said switch state signal is in said first state, said control circuit adjusts said control signal so as to operate said fuel pressure control device in a manner that increases the downstream fuel pressure until it reaches said reference pressure, and wherein, when said switch state signal is in said second state, said control circuit adjusts said control signal in accordance with the current signal so as to operate said fuel pressure control device using closed loop control of the electric current used by said control device, and wherein said control circuit operates said fuel pressure control device at a one hundred percent duty cycle when said switch state signal is in said first state.

13. The fuel pressure regulation system defined in claim 1, wherein said pressure switch is a two-state pressure switch and said reference pressure represents a desired downstream fuel pressure for the system.

14. The fuel pressure regulation system defined in claim 1, wherein said current signal is representative of a periodic sampling of the electrical current used by said fuel pressure control device.

15. A method of regulating fuel pressure within a fuel delivery system having an electrically-operable fuel pressure control device connected to adjust the fuel pressure within the system, the method comprising the steps of:

(a) sensing the fuel pressure using a pressure switch which provides an output that exhibits a first switch state when the fuel pressure is less than a reference pressure and that exhibits a second switch state when the fuel pressure is greater than or equal to the reference pressure, (b) measuring the magnitude of electric current used by said fuel pressure control device, (c) increasing the fuel pressure until it reaches the reference pressure when said pressure switch output exhibits the first switch state, and (d) operating said fuel pressure control device using closed loop control of the measured electric current when said pressure switch output exhibits said second switch state.

16. The method of claim 15, wherein step (c) further comprises increasing the fuel pressure by providing a high duty cycle control signal to said fuel pressure control device when said pressure switch output exhibits the first switch state.

17. The method of claim 15, wherein step (d) further comprises providing closed loop control using the measured electric current and a stored reference value.

18. The method of claim 17, further comprising the step of storing the measured electric current as the reference value when the pressure switch output changes from the first switch state to the second switch state.

19. A fuel pressure regulation system for use with an internal combustion engine, comprising:

a fuel pressure control device having a fuel inlet for receiving fuel, a fuel outlet in fluid communication with said inlet, a signal input for receiving a control signal, and a signal output, said fuel pressure control device being operable in response to said control signal to provide fuel to said outlet at a downstream fuel pressure that is dependent on said control signal, a pressure switch coupled to the downstream fuel for sensing the downstream fuel pressure and having a signal output for providing a switch state signal, wherein said switch state signal is in a first state when the downstream pressure is below a reference pressure and is in a second state when the downstream pressure is above the reference pressure, a current sensor for sensing the electric current used by said fuel pressure control device as a result of being operated by said control signal, said current sensor being operable to provide a current signal representative of the magnitude of that electric current, and a control circuit having a first signal input connected to said pressure switch signal output to receive said switch state signal, a second signal input connected to said current sensor to receive said current signal, and a signal output connected to said fuel pressure control device signal input to provide said control signal, wherein, when said switch state signal is in said first state, said control circuit operates in a first mode in which it activates said fuel pressure control device using a predetermined control signal that increases the downstream fuel pressure until it reaches said reference pressure, and wherein, when said switch state signal is in said second state, said control circuit operates in a second mode in which it adjusts said control signal in accordance with both the current signal received from the current sensor and a stored reference value obtained from a previous measurement of the electric current used by said fuel pressure control device.

20. The fuel pressure regulation system of claim 19, wherein said control circuit provides closed loop control of the electric current when said switch state signal is in said second state.

21. The fuel pressure regulation system of claim 19, wherein said control circuit generates said control signal as a pulse-width modulated control signal.

22. A fuel pressure regulation system for use with an internal combustion engine, comprising:

a fuel pressure control device having a fuel inlet for receiving fuel, a fuel outlet in fluid communication with said inlet, a signal input for receiving a control signal, and a signal output, said fuel press e control device being operable in response to said control signal to provide fuel to said outlet at a downstream fuel pressure that is dependent on said control signal, a pressure switch coupled to the downstream fuel for sensing the downstream fuel pressure and having a signal output for providing a switch state signal, wherein said switch state signal is in a first state when the downstream pressure is below a reference pressure and is in a second state when the downstream pressure is above the reference pressure, a current sensor for sensing the electric current used by said fuel pressure control device as a result of being operated by said control signal, said current sensor being operable to provide a current signal representative of the magnitude of that electric current, and a control circuit having a first signal input connected to said pressure switch signal output to receive said witch state signal, a second signal input connected to said current sensor to receive said current signal, and a signal output connected to said fuel pressure control device signal input to provide said control signal, wherein, when said switch state signal is in said first state, said control circuit operates in a first mode in which it activates said fuel pressure control device using a predetermined control signal that increases the downstream fuel pressure until it reaches said reference pressure, and wherein, when said switch state signal is in said second state, said control circuit operates in a second mode in which it adjusts said control signal in accordance with both the current signal received from the current sensor and a stored reference value obtained from a previous measurement of the electric current used by said fuel pressure control device, and wherein said control circuit generates said control signal as a pulse-width modulated control signal, and wherein said predetermined control signal is a one hundred percent duty cycle control signal.

23. A fuel delivery system for use with an internal combustion engine, comprising:

a fuel source having a fuel outlet, a fuel delivery pump having an inlet and an outlet, said fuel delivery pump inlet being in fluid communication with said fuel source outlet to draw fuel from said fuel source, a fuel pressure control device having a fuel inlet, a fuel outlet, and a signal input, wherein said fuel inlet is in fluid communication with said fuel delivery pump outlet, a pressure switch capable of sensing the downstream fuel pressure of fuel exiting said fuel pressure control device outlet and having a signal output for providing a switch state signal, wherein said switch state signal is in a first state when the downstream pressure is below a reference pressure and is in a second state when the downstream pressure is above the reference pressure, a current sensor for sensing the electrical current used by said fuel pressure control device as a result of being operated by said control signal, said current sensor being operable to provide a current signal representative of the magnitude of that electrical current, a control circuit having a first signal input connected to said pressure switch signal output to receive said switch state signal, a second signal input connected to said current sensor to receive said current signal, and a signal output connected to said fuel pressure control device signal input to provide said control signal, wherein, when said switch state signal is in said first state, said control circuit adjusts said control signal so as to operate said fuel pressure control device in a manner that increases the downstream fuel pressure until it reaches said reference pressure, and wherein, when said switch state signal is in said second state, said control circuit adjusts said control signal in accordance with the current signal so as to operate said fuel pressure control device using closed loop control of the electrical current used by said control device, and an injector having a fuel inlet in fluid communication with said fuel pressure control device outlet and having an outlet nozzle operable to deliver fuel from said fuel pressure control device outlet to a combustion chamber of a cylinder assembly.

24. A fuel delivery system for use with an internal combustion engine, comprising:

a fuel source having a fuel outlet, a fuel delivery pump having an inlet and an outlet, said fuel delivery pump inlet being in fluid communication with said fuel source outlet to draw fuel from said fuel source, a fuel pressure control device having a fuel inlet, a fuel outlet, and a signal input, wherein said fuel inlet is in fluid communication with said fuel delivery pump outlet, a pressure switch capable of sensing the downstream fuel pressure of fuel exiting said fuel pressure control device outlet and having a signal output for providing a switch state signal, wherein said switch state signal is in a first state when the downstream pressure is below a reference pressure and is in a second state when the downstream pressure is above the reference pressure, a current sensor for sensing the electrical current used by said fuel pressure control device as a result of being operated by said control signal, said current sensor being operable to provide current signal representative of the magnitude of that electrical current, a control circuit having a first signal input connected to said pressure switch signal output to receive said witch state signal, a second signal input connected to said current sensor to receive said current signal, and a signal output connected to said fuel pressure control device sign input to provide said control signal, wherein, when said switch state signal is in said first state, said control circuit adjusts said control signal so as to operate said fuel pressure control device in a manner that increases the downstream fuel pressure until it reaches said reference pressure, and wherein, when said switch state signal is in said second state, said control circuit adjusts said control signal in accordance with the current signal so as to operate said fuel pressure control device using closed loop control of the electrical current used by said control device, and an injector having a fuel inlet in fluid communication with said fuel pressure control device outlet and having an outlet nozzle operable to deliver fuel from said fuel pressure control device outlet to a combustion chamber of a cylinder assembly, and wherein said fuel pressure control device comprises a fuel pump driven by an electric motor.

* * * * *

UNITED STATES PATENT AND TRADEMARK OFFICE

CERTIFICATE OF CORRECTION

PATENT NO. : 6,609,501 B2
DATED : August 26, 2003
INVENTOR(S) : Kirk D. Doane et al.

It is certified that error appears in the above-identified patent and that said Letters Patent is hereby corrected as shown below:

Column 8,
Line 65, delete “press re” and insert -- pressure --.

Column 9,
Line 43, delete “itch” and insert -- switch --.

Column 11,
Line 19, delete “press e” and insert -- pressure --.

Column 12,
Line 58, delete “witch” and insert -- switch --.

Signed and Sealed this

Twenty-first Day of October, 2003

JAMES E. ROGAN
*Director of the United States Patent and Trademark Office*